United States Patent [19]

Yasuoka et al.

[11] Patent Number: 4,635,607

[45] Date of Patent: Jan. 13, 1987

[54] APPARATUS FOR CONTROLLING THE SUPPLY OF FUEL TO AN INTERNAL COMBUSTION ENGINE

[75] Inventors: Akimasa Yasuoka; Takeo Kiuchi, both of Tokyo, Japan

[73] Assignee: Honda Giken Kogyo Kabushiki Kaisha, Tokyo, Japan

[21] Appl. No.: 837,924

[22] Filed: Mar. 10, 1986

[30] Foreign Application Priority Data

Mar. 11, 1985 [JP] Japan ..... 60-46495

[51] Int. Cl.[4] ..... F02B 3/00

[52] U.S. Cl. ..... 123/479; 123/339; 123/493

[58] Field of Search ..... 123/479, 493, 339

[56] References Cited

U.S. PATENT DOCUMENTS

| | | | |
|---|---|---|---|
| 4,428,355 | 1/1984 | Yokooku | 123/479 |
| 4,483,299 | 11/1984 | Otobe | 123/479 |
| 4,531,490 | 7/1985 | Kishi | 123/339 |
| 4,580,220 | 4/1986 | Braun | 123/479 |

*Primary Examiner*—Ronald B. Cox

*Attorney, Agent, or Firm*—Armstrong, Nikaido, Marmelstein & Kubovcik

[57] ABSTRACT

An apparatus is provided for controlling the supply of fuel to internal combustion engine having a control valve for controlling the amount of air to be supplied to an engine piston downstream of a throttle valve. The apparatus comprises a detector for detecting any disorder in the amount of air and for providing a disorder indicating signal. An engine speed sensor detects the rotating speed of the engine and a throttle opening sensor detects the degree of opening of the throttle valve. A fuel cut circuit is coupled to the disorder detector, the engine speed sensor, and the throttle opening sensor for storing a fuel cut area defined by the degree of throttle opening and the rotating speed of the engine. The fuel cut circuit produces, in response to the disorder indicating signal, a fuel cut command signal when the outputs of the engine speed sensor and the throttle opening sensor indicate that the engine is operating within the fuel cut area.

4 Claims, 5 Drawing Figures

APPARATUS FOR CONTROLLING THE SUPPLY OF FUEL TO AN INTERNAL COMBUSTION ENGINE

BACKGROUND OF THE INVENTION

1. Field of the Invention

This invention relates to an apparatus for controlling the supply of fuel to an internal combustion engine. More particularly, it relates to an apparatus which can control the supply of fuel appropriately in the idling or low load condition of the engine to control the rotation of the engine to a demanded speed when a control valve provided in a bypass passage for a throttle valve has become in an uncontrollable condition in the open position and is incapable of controlling the amount of air being introduced into the engine. This results in an idling speed which is so high that the vehicle in which the engine is installed cannot be driven properly.

2. Description of the Prior Art

Control valves have been provided in a bypass passage extending between the upstream and downstream areas of a throttle valve in an air intake for an internal combustion engine, for controlling the amount of the air being introduced into the engine to thereby control the engine speed at a constant speed during its idling, i.e., when it is driven with the throttle valve maintained substantially in a closed position.

The degree of opening of the control valve is controlled during the idling of the engine in accordance with the amount of any external load required for an air conditioner, or the like, in order to ensure an appropriate supply of air to the engine and correspondingly appropriate supply of fuel so that the engine may produce an appropriate output.

Further, a fuel cutting system has been provided which reduces the supply of fuel when it is driven in a decelerating condition, in order to improve the fuel consumption.

The system functions to cut fuel, for example, when pressure on the accelerator has been released, resulting in substantially the complete closure of a throttle valve. The fuel cutting system ceases to function when the rotating speed of the engine has been reduced to a predetermined engine speed which is slightly higher than the idling speed.

When the engine speed continues to be maintained around the predetermined engine speed in a particular driving condition, the fuel cutting system repeatedly operates by turning on and off, and the operator repeatedly feels sudden changes of engine torque. Hitherto, in order to avoid the changes, the fuel cutting system has a hysteresis area between the engine speeds which stops and starts fuel cutting.

In order to prevent the hunting of the engine, it has hitherto been usual to raise the rotating speed of the engine at which the fuel cutting system functions and lower the rotating speed at which the system ceases to function. Therefore, the conventional fuel cutting system functions to cut the supply of fuel to reduce the engine speed in an area which is shown by broken lines in FIG. 5. It contains a hysteresis area.

The prior art as hereinabove described has the following problems:

(1) In the event an excessive increase in the amount of air being introduced into the engine during its idling has resulted from, for example, the failure of the control valve or a circuit for driving it, the engine is likely to have an increased rotating speed, as fuel is supplied in an increased quantity corresponding to the amount of the air.

Therefore, the engine is likely to hunt heavily around the hysteresis area of the fuel cut area. If the accelerator is pressed to start the vehicle, the fuel cutting system ceases to function and as a result, it is likely that the rotating speed of the engine will increase suddenly, or that the vehicle may start or be accelerated suddenly if the power of the engine is transmitted to the driving wheels (i.e., when the vehicle is in gear).

(2) There is also known a device for detecting any excessive reduction in the amount of the air being introduced into the engine during idling as a result of, for example, the failure of the control valve or the circuit for driving it, and keeping all the valves fully open to increase the amount of the air to avoid engine stall.

In this case, however, the fuel is supplied in an increased quantity corresponding to the amount of the air and the idling of the engine has an increased rotating speed. As a result, there arises the same problems as those stated in (1) above.

SUMMARY OF THE INVENTION

The present invention is directed to an apparatus for controlling the supply of fuel to internal combustion engine having a control valve for controlling the amount of air to be supplied to an engine cylinder downstream of a throttle valve. The apparatus comprises a detector for detecting any disorder in the amount of air and for providing a disorder indicating signal. An engine speed sensor detects the rotating speed of the engine and a throttle opening sensor detects the degree of opening of the throttle valve. A fuel cut circuit is coupled to the disorder detector, the engine speed sensor, and the throttle opening sensor for storing a fuel cut area defined by the degree of throttle opening and the rotating speed of the engine. The fuel cut circuit produces, in response to the disorder indicating signal, a fuel cut command signal when the outputs of the engine speed sensor and the throttle opening sensor indicate that the engine is operating within the fuel cut area.

DETAILED DESCRIPTION OF THE PREFERRED EMBODIMENT

The invention will now be described in further detail with reference to the drawings.

Figure 2:
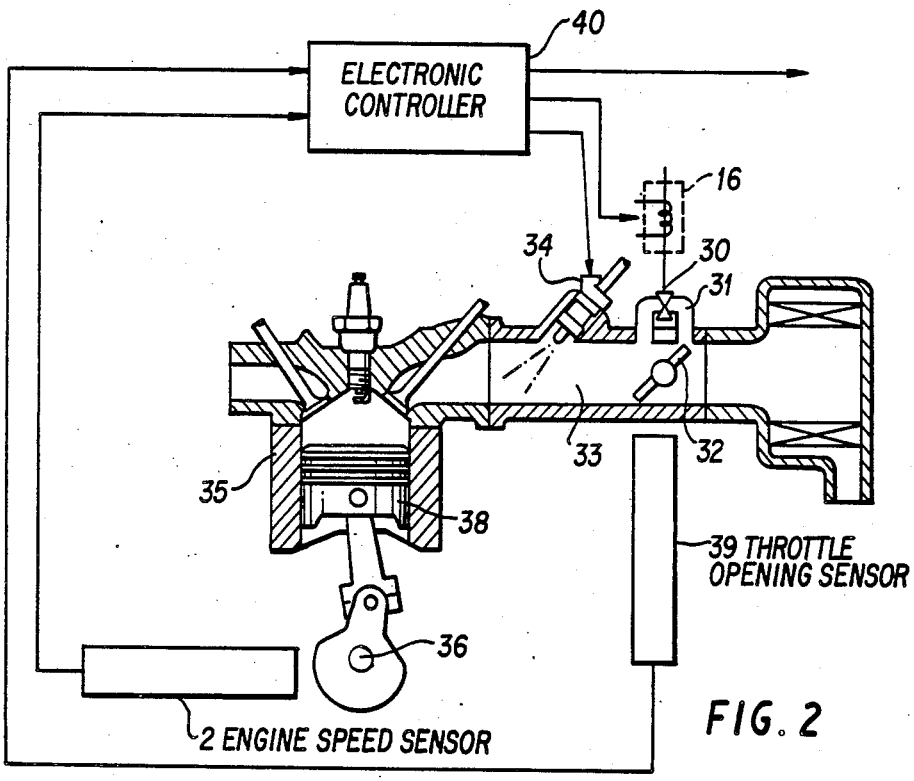
FIG. 2 is a schematic representation of the preferred embodiment of the present invention.

FIG. 2 is a diagrammatic representation of an apparatus embodying the present invention. If a throttle valve 32 is brought to a substantially fully closed position (for example, to an angle of, say, less than 3° to 5°, which will hereinafter be called the idling angle of opening), the amount of air being introduced through an intake manifold 33 is controlled by a control valve 30 provided in a bypass passage 31 extending between the upstream and downstream areas of the throttle valve 32. The opening degree of the control valve 30 depends on the amount of electric current supplied to a linear solenoid 16.

The amount of fuel which is injected through an injection nozzle 34 is determined by a known injector device in accordance with the amount of air being introduced through the intake manifold 33. A piston 38 in a cylinder 35 repeats reciprocal motion and imparts a rotating force to a crankshaft 36.

An engine speed sensor 2 detects the rotating speed of the engine by an appropriate method and supplies a digital signal to an electronic controller 40. A throttle opening sensor 39 supplies a digital signal indicating the opening degree of the throttle valve 32 to the electronic controller 40.

The electronic controller 40 controls the electric current to the linear solenoid 16, as will hereinafter be described in further detail, and also determines if the degree of throttle opening and the rotating speed of the engine indicate that the engine is operating within a predetermined fuel cutting area, when the amount of the air being introduced into the engine is uncontrollable. If the results of the determination are positive, the controller generates an output signal commanding a fuel cut.

Figure 3:
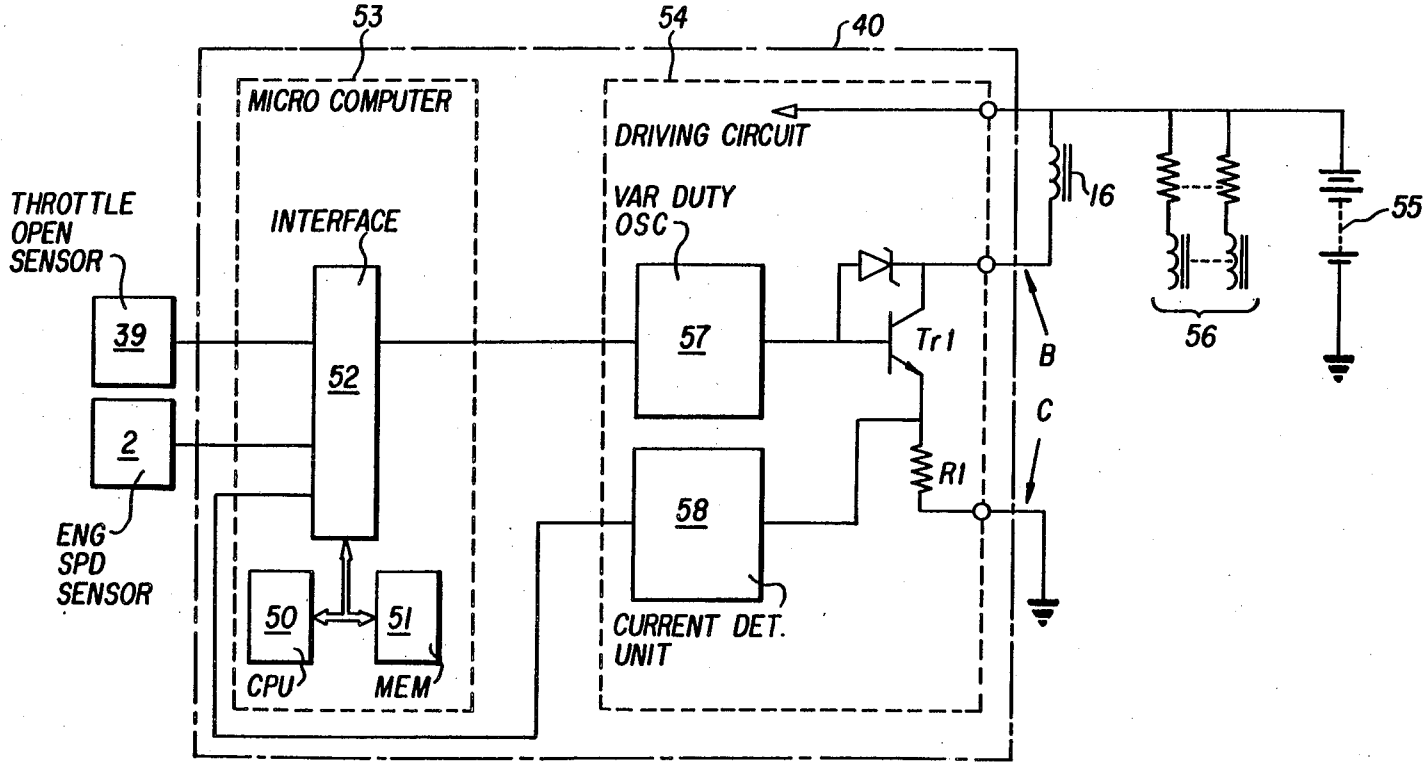
FIG. 3 is a circuit diagram showing the electronic controller shown in FIG. 2.

FIG. 3 is a circuit diagram showing the construction of the electronic controller 40. Like numerals are used to designate like or equivalent parts in both of FIGS. 2 and 3.

The electronic controller 40 comprises a microcomputer 53 and a driving circuit 54. The microcomputer 53 includes a central processing unit (CPU) 50, a memory 51 and an input and output signal processing circuit (interface) 52. The driving circuit 54 is, for example, adapted for controlling the electric current to the linear solenoid 16 in accordance with the output of the microcomputer 53.

According to the arrangement shown in FIG. 3, one end of the linear solenoid 16 is connected to the driving circuit 54, and the other end thereof is connected to a battery 55. Numeral 56 denotes a solenoid for the injection nozzle 34 (FIG. 2).

When the throttle valve 32 (FIG. 2) is open at the idling angle to enable the idling of the engine, a command value $I_{cmd}$ for the current to be supplied to the linear solenoid, is calculated by the CPU 50 in accordance with the following equation (1) and produced as an output by the interface 52:

$$I_{cmd}=I_{fbn}+I_e+I_{at}=I_{hac} \quad (1)$$

where $I_{fbn}$ is the term of PID feedback control (basic control), i.e., proportional (P), integral (I), or differential (d) control based on a deviation of the actual rotating speed of the engine detected by the engine speed sensor 2 from a target idling speed as a function of engine temperature, $I_e$ is the term of correction for adding a predetermined value in accordance with the load of an AC generator (ACG), i.e., its field current, $I_{at}$ is the term of correction for adding a predetermined value when the selector of an automatic transmission (AT) is positioned in a drive (D) range, $I_{hac}$ is the term of correction for adding a predetermined value when an air conditioner is in operation.

In order for the CPU 50 to calculate $I_{cmd}$ when all of the terms of equation (1) have been obtained, it is necessary to employ a number of appropriate sensors in addition to the engine speed sensor 2 and the throttle opening sensor 39 and to apply the outputs of the sensors to the microcomputer 53. This is, however, well known and a matter of common knowledge and thus none of the additional sensors are shown in the drawings.

The value of $I_{cmd}$, calculated in accordance with the equation (1), is fed from the interface 52 to a variable duty oscillator 57 forming a part of the driving circuit 54. The variable duty oscillator 57 outputs a pulse signal having a duty ratio controlled in accordance with $I_{cmd}$.

The output of the variable duty oscillator 57 is applied to the base of a transistor $Tr_1$ for driving the linear solenoid. As a result, the transistor $Tr_1$ is driven in accordance with the output of the oscillator 57.

According to the arrangement shown in FIG. 3, an electric current flows from the battery 55 to ground through the linear solenoid 16, the transistor $Tr_1$ and a resistance $R_1$, depending on the state of the transistor $Tr_1$. The electric current (solenoid current) provides the linear control of the opening degree of the control valve 30 (FIG. 2).

According to the arrangement of FIG. 3, the solenoid current is detected as a voltage drop at the resistance $R_1$ and is converted by a current detecting circuit 58 to a digital signal which is fed to the interface 52. In other words, the interface 52 receives a digital signal representing the amount of electric current $I_{act}$ which flows through the linear solenoid 16.

The signal indicating $I_{act}$ and the output of the engine speed sensor 2 (engine speed signal) enable the microcomputer 53 to determine whether the amount of air being introduced into the engine is uncontrollable, as will hereinafter be described in further detail.

If the amount of air has been determined as being uncontrollable, the apparatus determines whether it is necessary to cut the supply of fuel, based on the actual opening degree of the throttle valve 32 (throttle opening $\theta_{th}$) and the rotating speed $N_e$ of the engine.

The control of fuel supply will now be described with reference to the drawings.

Figure 4:
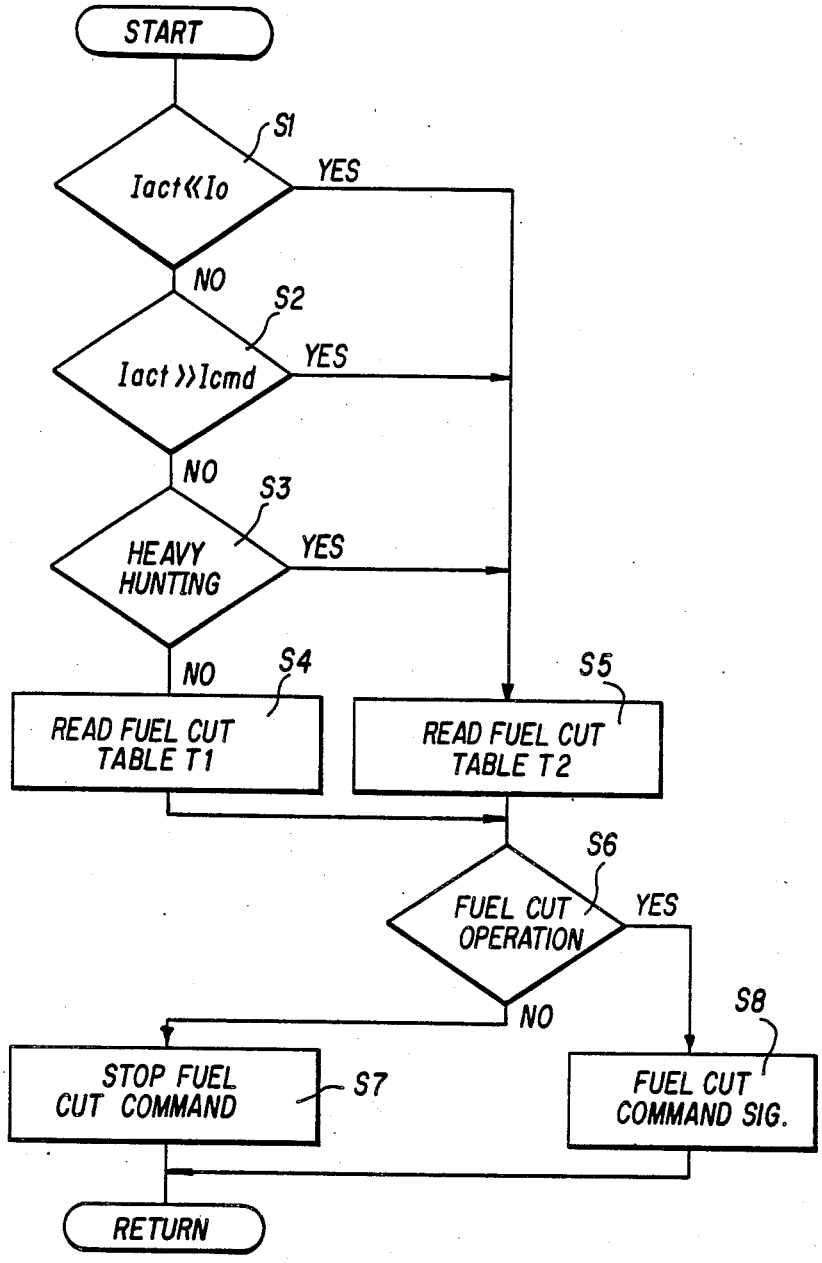
FIG. 4 is a flow chart showing the operation of the microcomputer.

FIG. 4 is a flow chart illustrating the operation of the microcomputer 53.

The microcomputer 53 starts its operation for the control of the fuel supply in accordance with an interrupt signal which is synchronized with the rotating speed of the engine.

Step S1—Determines whether the state that the electric current $I_{act}$ is much lower than the minimum value $I_O$ of $I_{cmd}$ (for example, about 200 mA) for a predetermined length of time (for example, three seconds). If the results of this determination are affirmative, processing proceeds to Step S5, and if not, it proceeds to Step S2.

When the result of the determination at Step S1 is affirmative, it is possible that one of the following events may have occurred in the circuit of FIG. 3:

(1) Shortcircuiting to ground of point B in FIG. 3;
(2) Breakage at point B;
(3) The transistor $Tr_1$ remains in its OFF position;
(4) Breakage at point C in FIG. 3; or
(5) The current detecting circuit 58 has failed and its output remains at a low level.

However, even if the affirmative results of the determination Step S1 are due to cause (1) or (5), an electric current flows to the linear solenoid 16. In the case of (1), the electric current which flows to the linear solenoid 16 is so large that the control valve 30 is substantially fully opened. In the case of (5), however, it is sometimes possible that an appropriate amount of electric current may flow to the linear solenoid 16 and thereby keep control valve 30 appropriately open.

When any of the causes (2) to (4) exists, no electric current flows to the linear solenoid 16, but the control valve 30 remains substantially in its fully closed position. In such an event, the apparatus of the present invention includes known appropriate means for fully opening the valves to ensure that an appropriate amount of air is introduced into the engine.

Step S2—The microcomputer determines whether the state that the value of $I_{act}$ is much greater than $I_{cmd}$ ($I_{act} >> I_{cmd}$) for a predetermined length of time (for example, three seconds). If the results of its determination are affirmative, the operation proceeds to Step S5, and if not, it proceeds to Step S3.

When the results of the determination at Step S2 are affirmative, it is possible that either of the events (6) and (7) may have occurred in the circuit of FIG. 3:

(6) The transistor $Tr_1$ remains in its ON position; or (7) The current detecting circuit 58 has failed and its output remains at a high level.

Even if the affirmative results of the determination Step S2 are due to the cause (7), it is sometimes likely that an appropriate amount of electric current may flow in the linear solenoid 16 and thereby keep the control valve 30 appropriately open.

Step S3—This step is to determine whether the engine has hunted heavily more than a predetermined number of times (for example, three times) within a predetermined length of time (for example, 10 seconds), or not.

More specifically, the microcomputer considers the output of the engine speed sensor 2 to see if the rotating speed of the engine has shown any variation having an amplitude wider than a predetermined amplitude, and determine whether the variation has occurred more than the predetermined number of times within the predetermined length of time.

If the results of this determination are affirmative, it proceeds to Step S5. If not, it concludes that there is nothing wrong with the intake system including the driving circuit 54 for the linear solenoid 16, and proceeds to Step S4.

When the results of the determination at Step S3 are affirmative, it is likely that any of the failures (8) to (10) may have occurred:

(8) The control valve 30 is mechanically fixed in a larger opened position than during its normal operation;

(9) While the throttle valve 32 comprises a primary valve and a secondary valve, the latter has a mechanical fault which disables it to return properly to its original position (the degree of throttle opening is typically represented by the degree of opening of the primary valve); or

(10) Air leaks into the intake manifold 33 due, for example, to the disconnection of a pipe for measuring the negative pressure prevailing in the intake manifold, or a pipe in an exhaust gas recirculating (EGR) system.

If a vehicle is equipped with a fuel cutting system for reducing its speed, hysteresis arises between the rotating speed of the engine at which the fuel cutting system is placed out of operation and its rotating speed at which the system is placed from its inoperative position to its operative position, as hereinbefore stated. Therefore, the presence of any of the causes (8) to (10) gives rise to the heavy hunting of the engine.

Figure 5:
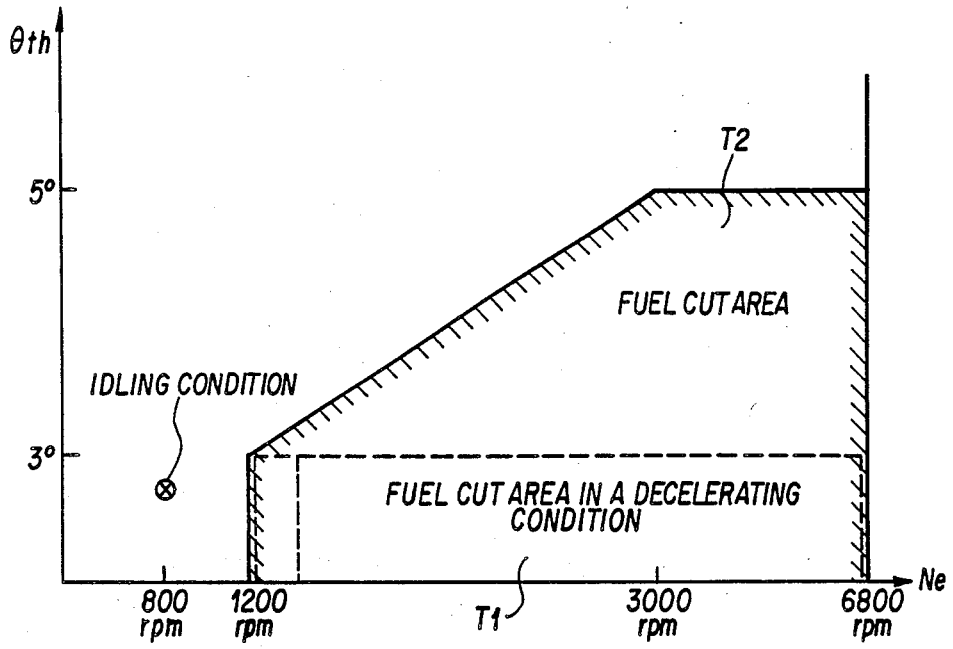
FIG. 5 shows the fuel cut decision table stored in the ROM of the memory device shown in FIG. 3 which defines a predetermined fuel cut area.

Step S4—A fuel cut decision area $T_1$ which employs the degree of throttle opening $\theta_{th}$ and the rotating speed of the engine $N_e$ to define a fuel cut area for operation at a reduced speed as inner area of dotted line in FIG. 5, is read from the newest information on the degree of throttle opening as detected by the throttle opening sensor 39 and the newest information on the rotating speed of the engine as detected by the engine speed sensor 2. The fuel cut decision area $T_1$ is stored in a ROM (read only memory) in the memory 51. If the engine is operating within the fuel cut area for operation at a reduced speed, the supply of fuel is cut by a known appropriate device.

Step S5—A fuel cut decision table $T_2$, which uses the degree of throttle opening $\theta_{th}$ and the rotating speed of the engine $N_e$ to define a fuel cut area as shown in FIG. 5, is read from the newest information on the degree of throttle opening detected by the throttle opening sensor 39 and the newest information on the rotating speed of the engine as detected by the engine speed sensor 2. The fuel cut decision table $T_2$ is also stored in the ROM of the memory 51.

The fuel cut area shown by oblique lines in FIG. 5 does not contain any hysteresis portion. Therefore, if the accelerator is not pressed, but the throttle valve 32 is substantially in its fully closed position (or has an open angle not exceeding 3° according to the apparatus of this invention as herein described), the fuel cutting system is activated if the engine has a rotating speed of 1200 rpm or above and its operation discontinued if the rotating speed of the engine drops below 1200 rpm.

Accordingly, the rotating speed of the engine is maintained substantially at 1200 rpm. The fuel cut area is such that if the accelerator is pressed on lightly, the rotating speed of the engine at which the supply of fuel is cut increase linearly until the throttle valve opens to an angle of 5°. This enables the smooth operation of the engine even if the intake system has a malfunction.

The speed of 6800 rpm appearing in FIG. 5 is illustrative of the maximum rotating speed that is mechanically permissible for an internal combustion engine.

Step S6—This step is to determine from the signal read out at Step S4 or Step S5 whether or not the engine is operating within the fuel cut area shown in FIG. 5. If the results of the determination are affirmative, the operation proceeds to Step S8, and if not, it proceeds to Step S7.

Step S7—This step is to discontinue the outputting of a fuel cut command signal at at Step S8 which will hereinafter be described. Then, the operation returns to the main program, and in main progra fuel is supplied into the cylinder.

Step S8—The microcomputer produces a fuel cut command signal as an output. As a result, the supply of fuel is cut in response to the fuel cut command signal. Then the operation returns to the main program.

Figure 1:
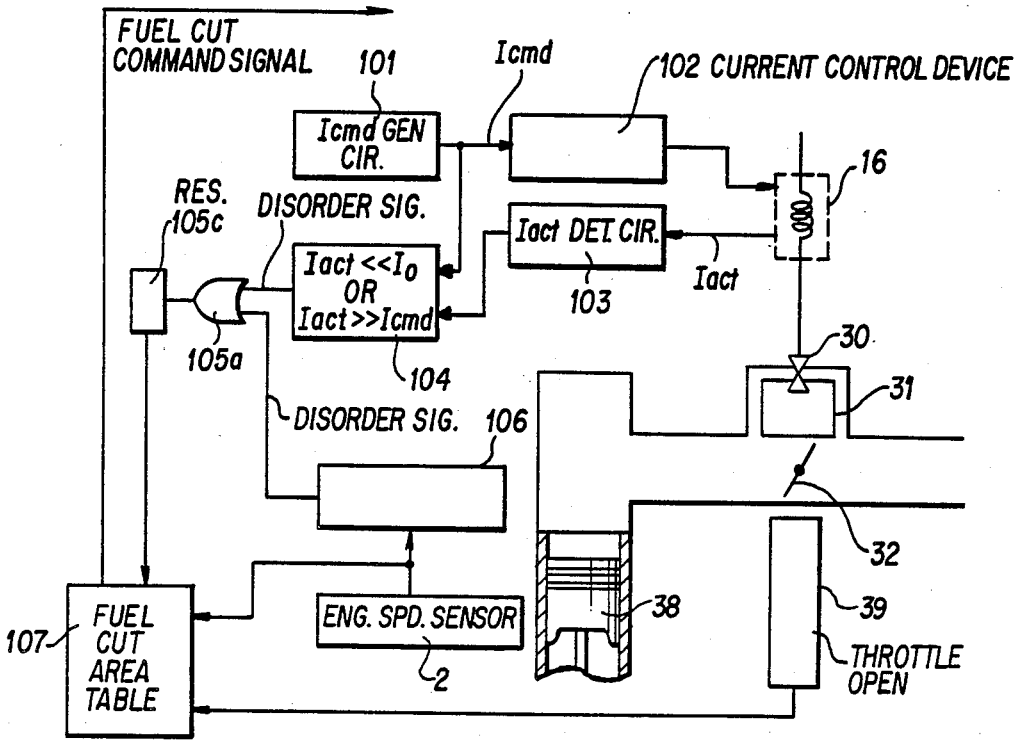
FIG. 1 is a block diagram showing the operation of this invention.

Referring now to FIG. 1, which is a block diagram showing the operation of the apparatus according to this invention, an $I_{cmd}$ producing device 101 produces an $I_{cmd}$ signal after calculation in accordance with, for example, equation (1). An electric current control device 102 is driven in response to the $I_{cmd}$ signal to control the amount of the electric current flowing to the linear solenoid 16. An $I_{act}$ detecting device 103 detects the amount of electric current $I_{act}$ which flows through the linear solenoid 16.

An $I_{act} << I_O$ or $I_{act} >> I_{cmd}$ device 104 commpares the values of $I_{act}$ and $I_{cmd}$ and determines whether the state that $I_{act}$ is much lower than $I_O$ ($I_O$ being the minimum value of $I_{cmd}$ as hereinbefore stated), or much higher than $I_{cmd}$, has lasted for a predetermined length of time, or not.

If the results of the determination are affirmative, the device 104 feeds a disorder indicating signal (having a logic value of "1") to one of the terminals of an OR gate 105*a*.

A hunting detecting device 106 receives the output of the engine speed sensor 2 and determines whether the engine has hunted heavily more than a predetermined number of times within a predetermined length of time. If it has detected any such hunting, it feeds a disorder indicating signal (having a logic value of "1") to the other terminal of the OR gate 105*a*.

The OR gate 105*a* outputs a "1" signal when it has received an output signal from either of the devices 104 and 106. The output of the OR gate is held by a resistor 105*c* and fed to a fuel cut area storing device 107.

The device 107 stores a fuel cut decision table (such as table $T_2$) showing the fuel cut area defined by the degree of throttle opening $\theta_{th}$ and the rotating speed of the engine $N_e$.

When it has received the "1" signal from the resistor 105*c*, the device 107 outputs a fuel cut command signal (having a logic value of "1") if the degree of throttle opening and the rotating speed of the engine indicate that the engine is operating within the fuel cut area.

Advantages of the Invention

As is obvious from the foregoing description, this invention provides the following advantages:

(1) Even if there is a failure of, for example, the control valve or the circuit for driving it which cause an excessive increase in the amount of the air being introduced into the engine during idling, or an excessive decrease in the amount of air which results in the opening of all the valves and eventually the supply of an excessive amount of air to the engine, the supply of fuel is cut if the rotating speed of the engine exceeds a predetermined level. Therefore, there is no idling of the engine at a speed exceeding a predetermined level.

The fuel cut area is such that the rotating speed of the engine at which the supply fuel is cut increases linearly with an increase in the degree of throttle opening. Therefore, there is no possiblity of the engine having a suddenly increased rotating speed, or the vehicle starting or being accelerated suddenly, even if the accelerator is pressed from when the throttle valve is substantially in its fully closed position.

(2) The fuel cut area according to this invention is free from any hysteresis, as opposed to the prior art. Therefore, there is no heavy hunting of the engine.

Thus, the apparatus of the present invention improves the riding comfort of a vehicle and the ease of driving as compared to a vehicle equipped with a conventional fuel cutting system, when the amount of air being introduced into the internal combustion engine is uncontrollable.

The present invention may be embodied in other specific forms without departing from the spirit or essential characteristics thereof. The presently disclosed embodiments are therefore to be considered in all respects as illustrative and not restrictive, the scope of the invention being indicated by the appended claims, rather than the foregoing description, and all changes which come within the meaning and range of equivalency of the claims are, therefore, to be embraced therein.

We claim:

1. In an apparatus for controlling the supply of fuel to an internal combustion engine having a control valve means for controlling the amount of air to be supplied to an engine piston downstream of a throttle valve, the improvement which comprises:

means for detecting any disorder in the amount of air and outputting a disorder indicating signal;

an engine speed sensor for detecting the rotating speed of the engine;

a throttle opening sensor for detecting the degree of opening of said throttle valve; and fuel cut means coupled to said disorder detecting means, said engine speed sensor, and said throttle opening sensor, for determining a fuel cut area defined by the degree of throttle opening and the rotating speed of the engine, and for executing fuel cut in response to the disorder indicating signal, when the output of said engine speed sensor and said throttle opening sensor indicate that the engine is operating within the fuel cut area.

2. An apparatus as set forth in claim 1, wherein the fuel cut area is defined such that the rotating speed of the engine increases with an increase in the degree of throttle opening.

3. An apparatus as set forth in claim 1 or claim 2, wherein the fuel cut area ceases to exist when the degree of throttle opening exceeds a predetermined level irrespective of the rotating speed of the engine.

4. An apparatus as set forth in claim 1 or claim 2, wherein said control valve means includes a bypass extending around said throttle valve, a control valve in said bypass, and a solenoid for operating said control valve, wherein the degree of opening is proportional to the amount of current supplied to said solenoid, and wherein said disorder detecting means comprises an $I_{act} << I_O$ or $I_{act} >> I_{cmd}$ determining means for comparing the amount of current $I_{act}$ supplied to said solenoid with a command value $I_{cmd}$ of current to be supplied to said solenoid, for determining whether a predetermined state of $I_{act} << I_0$ ($I_O$ being the minimum value of $I_{cmd}$) or $I_{act} >> I_{cmd}$ has lasted for a predetermined length of time, and for outputting a disorder indicating signal if the results of the determination is affirmative, and means for determining from the output of said engine speed sensor whether the engine is hunting, and outputting a disorder indicating signal if the hunting of the engine occurs more than a predetermined number of times within a predetermined length of time.

* * * * *